United States Patent [19]

Pomares

[11] Patent Number: 4,594,015

[45] Date of Patent: Jun. 10, 1986

[54] PAINT APPLICATOR

[76] Inventor: Francis J. Pomares, 124 Russell St., White Plains, N.Y. 10606

[21] Appl. No.: 618,682

[22] Filed: Jun. 8, 1984

[51] Int. Cl.[4] ..... A46B 11/00; A46B 11/02

[52] U.S. Cl. ..... 401/266; 401/139; 401/183; 401/207; 401/268

[58] Field of Search ..... 401/183, 186, 207, 14, 401/281, 266, 139, 268

[56] References Cited

U.S. PATENT DOCUMENTS

| | | | |
|---|---|---|---|
| 1,939,612 | 12/1933 | Rose | 401/207 |
| 2,118,051 | 5/1938 | MacMichael | 401/266 |
| 2,601,689 | 7/1952 | Mallard | 401/207 X |
| 2,798,240 | 7/1957 | Jaehne . | |
| 2,820,234 | 1/1958 | Rigney | 401/186 |
| 2,827,650 | 3/1958 | Morrill et al. | 401/186 |
| 3,107,388 | 10/1963 | Groves . | |
| 3,363,279 | 1/1968 | Bright, Jr. | 401/183 |
| 3,372,975 | 3/1968 | Johnson . | |
| 3,459,482 | 8/1969 | Fears | 401/266 X |
| 3,462,231 | 8/1969 | Pomares . | |
| 3,537,800 | 11/1970 | Moceri . | |
| 3,809,484 | 5/1974 | Bradshaw . | |
| 3,811,783 | 5/1974 | Johnson | 401/183 X |

FOREIGN PATENT DOCUMENTS

| | | | |
|---|---|---|---|
| 824894 | 12/1959 | United Kingdom | 401/183 |

*Primary Examiner*—Steven A. Bratlie

*Attorney, Agent, or Firm*—Eugene E. Geoffrey, Jr.

[57] ABSTRACT

A paint applicator having an essentially cylindrical paint container serving as a handle and formed of a resilient material, a threaded cap closing the container, a paint applicating head and a conduit connecting the applicating head to the paint container. The applicating head includes a metal plate affixed to the conduit and having an opening for the supply of paint, a layer of sponge-like material overlying the plate, a porous layer having a nap on one surface overlying the sponge-like material and a paint impervious layer covering at least the top edge of the sponge-like material.

4 Claims, 6 Drawing Figures

PAINT APPLICATOR

This invention relates to paint applicators and more specifically to a novel and improved paint applicator particularly useful for painting window sash and other similiar surface configurations wherein paint is to be applied to one surface without overlapping an adjoining surface as in the case of windows and doors.

Known paint applicators, of which there have been a variety, provide means for applying paint to window sash and the like, but such known applicators have not been found satisfactory for various reasons including the lack of means to control the supply of paint to an applicator to prevent the application of paint to an adjoining surface or accidental dripping of paint.

One object of this invention resides in the provision of a novel and improved paint applicator for painting window sash and other similar surfaces which facilitates the painting of nonuniform surfaces, corners as in the case of window sash and the like while preventing application of paint to adjoining surfaces and which does not require experience in its use.

Another object of the invention resides in the provision of a novel and improved paint applicator that is easy to use, easy to clean and which can be maintained at a relatively low cost.

A further object of the invention resides in the provision of a novel and improved paint applicator that is characterized by its simplicity, effectiveness in minimizing painting time and relatively low cost.

A still further object of the invention resides in the provision of a novel and improved paint applicator.

The paint applicator, in accordance with the invention, includes a paint container formed of a flexible material, a removable cap for the container, a paint distributing head and a support tube therefor carried by the cap and supplying paint to the distributing head. The paint distributing head includes a metal plate affixed at an angle to the support tube and having an opening communicating therewith. A layer of cellular sponge-like material overlies the plate and may have an opening aligned with the opening in the plate and a sealing material applied to the edges. A second layer of woven or porous fabric having a short nap on one surface is adhered to the sponge-like layer and a shielding strip of plastic material overlies the outer edge of the sponge-like material and the adjoining edge of the fabric and nap. In this way, controlled amounts of paint can be supplied to the fabric for application to a surface and the shield prevents application of paint to an adjoining surface, such as a window pane when painting the window molding.

The above and other objects and advantages will become more apparent from the following description and accompanying drawings forming part of this application.

IN THE DRAWINGS

Figures 1, 2, 3, 4, 5, 6:
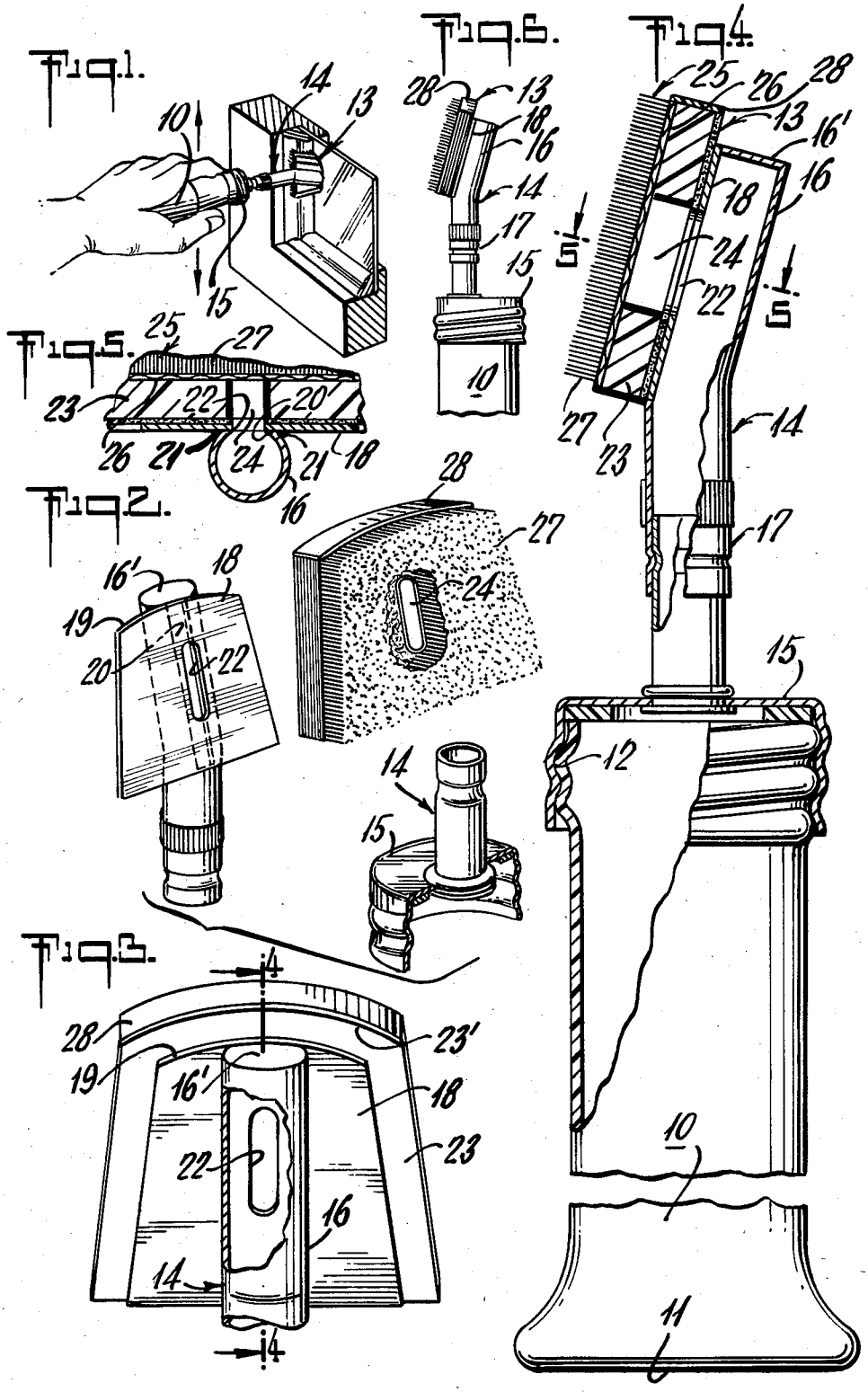
FIG. 1 is a perspective view illustrating the paint applicator in accordance with the invention and its use for painting a window molding.
FIG. 2 is an exploded perspective view, with parts in section, of the paint distributing head in accordance with the invention.
FIG. 3 is a rear perspective view, with parts in section, of the paint distributing head shown in FIG. 2.
FIG. 4 is a cross sectional view of FIG. 3 taken along the line 4—4 thereof and also shows the tubular paint supply for the paint distributing head.
FIG. 5 is a cross sectional view of FIG. 4 taken along the line 5—5 thereof.
FIG. 6 is a fragmentary side elevational view of the modified form of the invention.

The paint applicator, in accordance with the invention, comprises a tubular structure 10 formed of a resilient material such as rubber, plastic or the like having a closed bottom 11 and terminating at the upper end in a threaded portion 12. The paint distributing head is generally denoted by the numeral 13 and is fixed to the upper angularly disposed portion 16 of the conduit 14. The lower end of the conduit 14 is affixed to a cap 15 for the tube or paint container 10 for the purpose of conducting paint from the container to the distributing head 13. If desired, the conduit 14 may include a rotatable fitting 17 to permit angular adjustment of the paint distributing head 13 relative to the tubular member 10 so that the head will lie flat against the surface being painted even though the tubular member 10 might rotate as the user moves the distributing head over the surface being painted. The distributing head 13 includes a metal plate 18 in the form of a truncated triangle and having an upper curved edge 19. The upper angularly disposed portion 16 of the conduit 14 is cut away as indicated at 20 in FIG. 2 and the plate 18 is secured to the conduit section 16 by soldering as indicated at 21 or other suitable means to close the opening 20. The upper end of the conduit section 16 is closed by a plate 16' or other suitable means and the plate 18 includes an elongated opening 22 for the passage of the paint to the distributing head.

A layer of sponge-like material 23 is adhered to the surface of the plate and extends from the top and side edges thereof. A sealing material is applied to all exposed edges of the sponge-like material as well as the exposed portions of the rear surface to restrict the discharge of paint solely to the front surface thereof. If desired, the sponge-like material 23 may also include a central opening 24 aligned with the opening 22 though it has been found that this opening 24 is optional and is normally not required.

The paint applicating element 25 overlies and is secured to the front face of the sponge-like material and includes a layer of woven fabric 26 having a short nap 27 extending from the front side thereof.

As will be observed more clearly in FIGS. 2 and 3, the upper edge of the sponge-like material 23 is curved as denoted by the numeral 23' and a layer of paint impervious material 28 having a relatively smooth outer surface and preferably a low coefficient of friction is cemented to the edge 23' of the sponge 23. This is particularly important when applying paint to a molding such as the molding on window sash to prevent paint from being accidentally applied to the window pane as illustrated, for instance, in FIG. 1.

When the invention thus far described, paint from the tubular member 10 may either flow by gravity into the paint applicator or be forced into the distributing head by merely squeezing the tube 10. The paint passes through the conduit 14 and thence through the opening 22, either directly into the sponge or through the opening 24 into the paint applicating element 25 which includes the layer of woven material 26 and the nap 27. Paint will normally saturate the sponge 23 so that the paint will emerge over the entire surface of the nap 27.

When using the paint applicator, the user can hold the paint applicator 13 parallel to the molding being painted, as shown in FIG. 1, but with the utilization of the rotatable joint 17, the applicator will automatically adjust its position so that it will always lie flat on the surface being painted. with this arrangement, the painting of surfaces, such as window sash, is greatly facilitated and at the same time, the paint will be prevented from coating the edges of the glass pane.

A modified embodiment of the invention is illustrated in FIG. 6 wherein like numerals have been utilized to denote corresponding components in previous figures. In this form of the invention, the conduit 14 is positioned at an off-center location on the cap 15. With this arrangement, the paint distributing head 13 is approximately aligned with an edge of the paint containing tube 10 and thereby provides added clearance between the surface to be painted and the paint supply tube 10.

While only certain forms of the invention have been illustrated and described, it is apparent that alterations, changes and modifications may be made without departing from the true scope and spirit thereof.

What is claimed is:

1. A paint applicator comprising paint supply means including a tubular paint supply conduit, a paint distributing head angularly affixed to one end of said conduit, said paint distributing head including a metal plate affixed to said conduit, said plate having an opening communicating with said conduit and a convex top or outer edge portion, a layer of sponge-like material affixed to said metal plate and extending from at least the top and side edges thereof, with the top edge having a convex configuration, said material having a central opening extending therethrough and aligned with the first said opening, a paint applicating layer adhesively secured to the surface of said sponge-like material and a sealing material coating the exposed portions of the sponge-like material to restrict the flow of paint to the sponge-like material and said paint applicating layer and a layer of aint impervious material adhered to the convex outer surface of said sponge-like layer of material and at least part of said paint applicating layer, the outer surface of the last said material being smooth and having a low coefficient of friction.

2. A paint applicator according to claim 1 wherein said paint supply means is in the form of an elongated tube of resilient material having an open end and a cap sealing said open end, said tubular conduit having its other end sealed to said cap and communicating with said tube for receiving a supply of paint therefrom.

3. A paint applicator according to claim 2 wherein said conduit is centrally positioned on said cap.

4. A paint applicator according to claim 2 wherein said conduit is positioned on said cap at a point between the center and the edge of said cap and said conduit includes a rotatable coupling for angularly positioning said paint distributing head relative to said paint supply means.

* * * * *